US010745848B2

(12) United States Patent
Pittalis et al.

(10) Patent No.: US 10,745,848 B2
(45) Date of Patent: Aug. 18, 2020

(54) HOUSEHOLD APPLIANCE FOR WASHING

(71) Applicant: Whirlpool EMEA S.p.A., Pero (IT)

(72) Inventors: Giacomo Pittalis, Montemarciano (IT); Elisa Polverini, Staffolo (IT); Roberto Tarabù, Montecarotto (IT); Luca Andrenacci, Jesi (IT); Romina Catani, Jesi (IT); Zakaria Khalfaoui, Recanati (IT); Filippo Matarazzi, Gualdo Tadino (IT); Alessandro Falsetti, Turin (IT)

(73) Assignee: Whirlpool EMEA S.p.A., Pero (IT)

( * ) Notice: Subject to any disclaimer, the term of this patent is extended or adjusted under 35 U.S.C. 154(b) by 90 days.

(21) Appl. No.: 14/976,357

(22) Filed: Dec. 21, 2015

(65) Prior Publication Data

US 2016/0177492 A1 Jun. 23, 2016

(30) Foreign Application Priority Data

Dec. 23, 2014 (IT) ..... PR2014A0107

(51) Int. Cl.
*D06F 39/02* (2006.01)
*D06F 39/08* (2006.01)

(52) U.S. Cl.
CPC ..... *D06F 39/022* (2013.01); *D06F 39/02* (2013.01); *D06F 39/087* (2013.01)

(58) Field of Classification Search
CPC ..... D06F 39/02; D06F 39/022
(Continued)

(56) References Cited

U.S. PATENT DOCUMENTS 10,370,788 B2 * 8/2019 Kim ..... D06F 39/022
2004/0216499 A1 * 11/2004 Bongini ..... D06F 37/28 68/17 R (Continued)

FOREIGN PATENT DOCUMENTS

EP 2602378 A1 * 6/2013 ..... D06F 39/022
GB 880 049 A 10/1961

(Continued)

OTHER PUBLICATIONS

Maytag Large Capacity Washer, 2015 model (available at https://outlet.whirlpool.com/laundry-1/laundry-3/-%5bMHW4300DC%5d-5985596/MHW4300DC/) (Year: 2015).*

(Continued)

*Primary Examiner* — Michael E Barr
*Assistant Examiner* — Kevin G Lee
(74) *Attorney, Agent, or Firm* — Price Heneveld LLP

(57) ABSTRACT

A household appliance for washing fabric items, comprising:

a washing compartment (2);

an opening (3) for access to the washing compartment to enable introduction and extraction of the laundry items;

a hatch door (4) for access to the washing compartment (2), mobile between a closed position in which it occludes said access opening (3) and an open position in which it enables access to the washing compartment (2);

a border (5) of said access opening to the washing compartment (2), said border (5) abutting the hatch door (4) in the closed position;

a first tank (61) containing a detergent for washing;

a first indicator (610) located on the border (5) and indicating a load level of said first tank (61).

20 Claims, 3 Drawing Sheets

(58) Field of Classification Search
USPC ..... 68/12.18
See application file for complete search history.

(56) References Cited

U.S. PATENT DOCUMENTS

| | | | | |
|---|---|---|---|---|
| 2012/0019114 | A1* | 1/2012 | Hong | D06F 39/02 312/228.1 |
| 2012/0036901 | A1* | 2/2012 | Mackay | D06F 29/00 68/17 R |
| 2012/0159998 | A1* | 6/2012 | Bolduan | D06F 39/022 68/17 R |
| 2013/0263631 | A1* | 10/2013 | D'Andrea | D06F 39/02 68/17 R |
| 2017/0107657 | A1* | 4/2017 | Kim | D06F 39/02 |
| 2017/0159221 | A1* | 6/2017 | Cho | D06F 33/02 |

FOREIGN PATENT DOCUMENTS

| | | | |
|---|---|---|---|
| JP | H05 228294 | A | 9/1993 |
| WO | WO 2011/012468 | A2 | 2/2011 |

OTHER PUBLICATIONS

Italian Search Report dated Aug. 10, 2015 for Italian Application No. PR2014000107 filed on Dec. 23, 2014, 8 pages.

* cited by examiner

HOUSEHOLD APPLIANCE FOR WASHING

CROSS REFERENCE TO RELATED APPLICATIONS

This application claims priority to Italian Application No. PR2014A000107, filed on Dec. 23, 2014, the content of which is hereby incorporated by reference in its entirety.

The object of the present invention is a household appliance for washing laundry items, for example a washing machine or a washer-dryer.

In particular the household appliance is included in a type that in the sector is known as "long fill". A long-fill washing machine has a tank from which the machine automatically collects a quantity of detergent required for carrying out a given washing cycle.

The introduction of the detergent takes place periodically and enables carrying out a multiplicity of cycles. With the aim of controlling a level of detergent present in the tank, a level indicator is present, located in the user interface positioned on the front of the household appliance.

The washing machine is also provided with a drawer for introduction of the detergent for enabling manual introduction, before each washing cycle, of a single dose of detergent.

A drawback of this constructional solution is linked to the fact that the level indicator is not always easily visible to a user. For example, to introduce the items into washing compartment a user is normally bent over in proximity of the front of the washing machine and collects the laundry items located on a basket resting on the floor (or from a special compartment fashioned in the base of the household appliance. In a case where the user in this situation desires to check that the washing machine contains the detergent necessary for carrying out a washing cycle, the user must straighten up and read the information provided on the user interface located on the front.

In this context, the technical task underpinning the present invention is to propose a household appliance which enables obviating the drawbacks described above. In particular, an object of the present invention is to propose a household appliance that has an optimised ergonomic system.

The defined technical task and the specified aims are substantially achieved by a household appliance comprising the technical characteristics set out in one or more of the appended claims.

Further characteristics and advantages of the present invention will become more apparent from the following indicative, and hence non-limiting, description of a preferred, but not exclusive, embodiment of a system and a household appliance as illustrated in the appended drawings, in which.

Reference number 1 in the accompanying figures denotes a household appliance for washing items. For example: a washing machine or a washer-dryer. The household appliance 1 enables washing of fabric items. The household appliance 1 comprises a washing compartment 2. The washing compartment 2 houses a rotary drum in which the items to be washed are deposited.

The household appliance 1 further comprises an opening 3 for access to the washing compartment 2 to enable introduction and extraction of the items.

Figure 2:
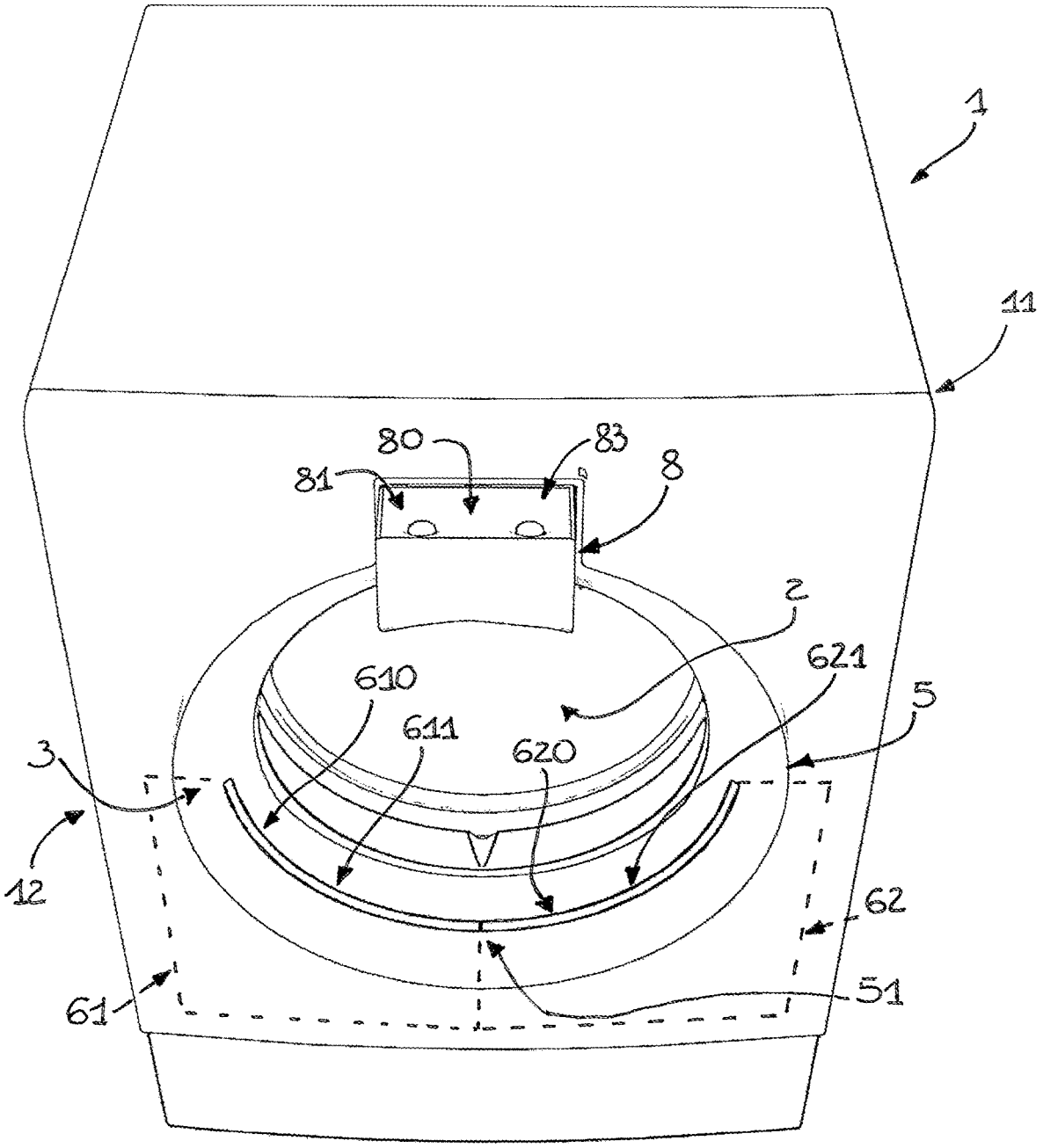
FIGS. 2 and 3 are further configurations of the household appliance of FIG. 1, with some parts removed.

The household appliance 1 is front-loading. It comprises a door 4 for access to the washing compartment 2. The door 4 is not illustrated in FIGS. 2 and 3, for the sake of simplicity.

The door 4 is mobile between a closed position in which it occludes said access opening 3 and an open position in which it enables access to the washing compartment 2 (through the opening 3).

The household appliance 1 further comprises a border 5 of the access opening to the washing compartment 2. The border 5 surrounds the opening 3. Further, the border 5 abuts the door 4 in the closed position; The border 5 is substantially circular.

When moving between the open position and the closed position the door 4 moves with respect to the border 5. The border 5 is solidly constrained to a casing that externally delimits the household appliance 1.

The door 4 can comprise a transparent porthole (not illustrated) which enables to see inside the washing compartment 2 from outside the household appliance 1. In particular the porthole enables to see inside the rotary drum. The household appliance 4 comprises a perimeter structure which surrounds the transparent porthole window and which in the closed position of the door 4 is abutted by the border 5.

Figure 1:
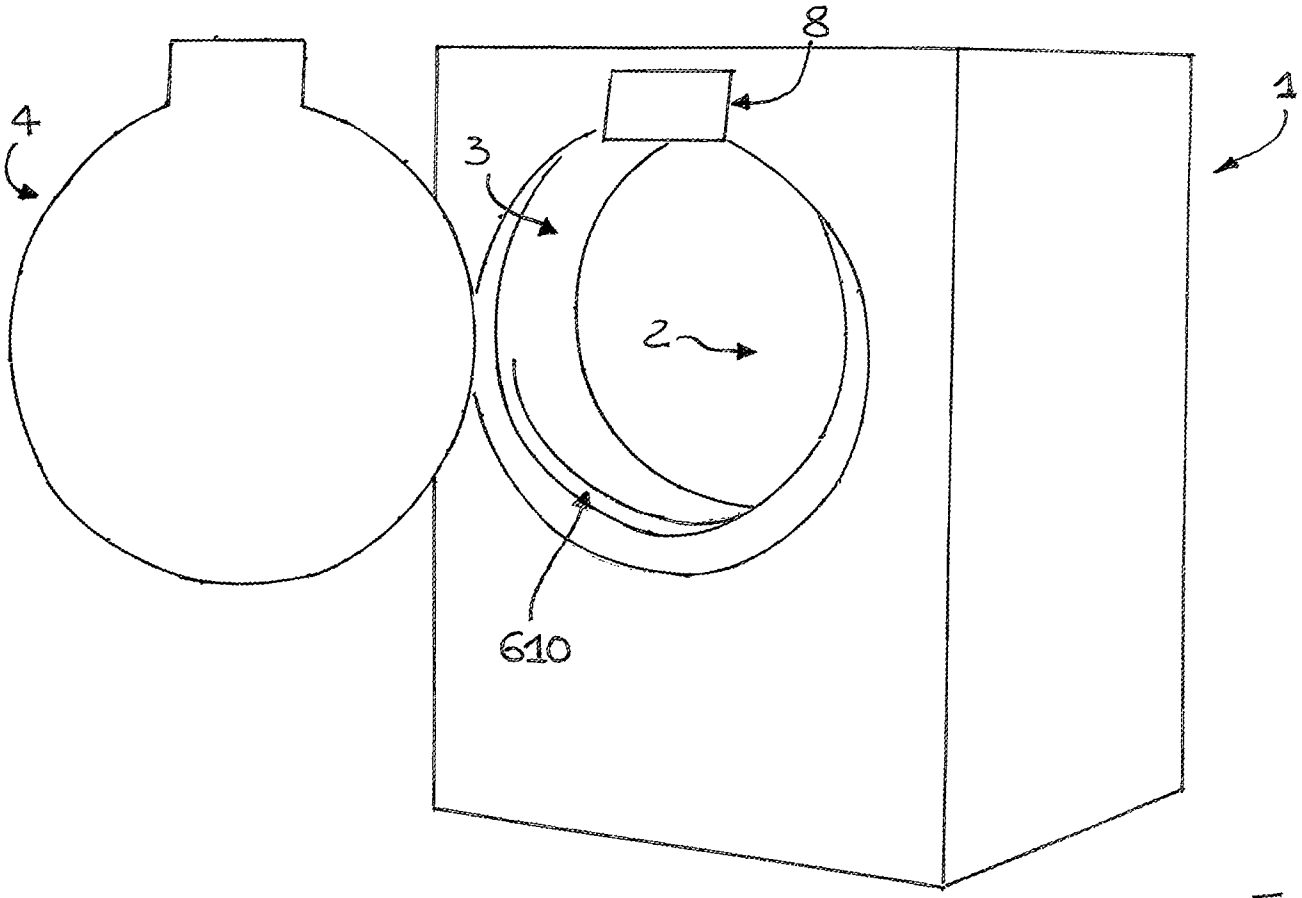
FIG. 1 shows a perspective view of a household appliance according to the present invention in a first configuration.

The household appliance comprises a first tank 61 containing a detergent for washing (the first tank 61 is schematically illustrated in FIG. 1). The first tank 61 is advantageously located posteriorly of a front cladding (of the casing) and externally of the washing compartment 2.

The household appliance 1 further comprises a first indicator 610 of a load level (filling) of said first tank 61.

The first indicator 610 is integrated in the border 5. With the door 4 open the first indicator 610 is therefore visible by a user.

The first indicator 610 comprises a window 611. The window 611 is arranged along the border 5.

The window 611 develops in an up and down direction. In particular the border 5 is elongate and extends in an arc for a portion of the border 5. In a solution by way of example the window 611 of the first indicator 610 extends for about one quarter of the perimeter of said opening 3 (and possibly for more than a quarter).

The first indicator 610 develops upwards from a lower portion 51 of the border 5. The window 611 is in fluid communication with the first tank 61. In particular the window 611 contributes to delimiting the first tank 61. The detergent present in the first tank 61 is visible through the window 611 of the first indicator. The level of detergent indicated by the first indicator 610 is therefore the same level as the detergent present in the first tank 61. The reduction of the level of the first indicator 610 thus indicates the reduction of the level of detergent in the first tank 61.

The window 611 is advantageously graduated with the aim of giving more indications to a user.

The household appliance 1 comprises a second tank 62 which contains a washing additive (for example a softener).

The household appliance 1 further comprises a second indicator 620 of a load level of said second tank 62.

The second indicator 620 comprises a window 621 which is arranged along the border 5. The window 621 develops in an up and down direction. Further, the border 621 is elongate and extends in an arc for a portion of the border 5.

In a solution by way of example the window 621 of the second indicator 620 extends for about one quarter of the perimeter of said opening 3 (and possibly for more than a quarter).

The second indicator 620 develops upwards from a lower portion of the border 5. The window 621 is in fluid communication with the second tank 62. The window 621 contributes to delimiting the second tank 62. The level of washing additive indicated by the second indicator 620 is therefore the same level as the additive present in the second tank 62. The reduction of the level of the second indicator 620 thus indicates the reduction of the level of detergent in the second tank 62.

The detergent present in the second tank 62 is visible through the window 621 of the second indicator. The window 621 is advantageously graduated with the aim of giving more indications to a user.

The first and the second indicator 610, 620 develop along two arcs which are arranged along the border 5 on two opposite sides with respect to an imaginary vertical plane 7 which intercepts the border 5 and which is equidistant with respect to two flanks 11, 12 of the household appliance 1. The plane 7 thus cuts the household appliance along a front-to-back direction.

The first and the second indicator 610, 620 advantageously extend symmetrically with respect to the imaginary plane 7. The user can therefore directly see the level of detergent and the level of washing additive present in the second tank 62.

The household electrical device 1 comprises a detergent drawer 8 (for the introduction of the detergent and possibly the washing additive present in the second tank 62). The drawer 8 is frontally extractable.

The drawer 8 assumes at least a first position (see FIG. 2) and a second position (see FIG. 1). In the first position (FIG. 2) a first introduction zone 81 of the detergent in the drawer 8 is in communication with the first tank 61.

The first zone 81 advantageously comprises a first hole 810 afforded in a structure 80 (preferably removable) positioned in the drawer 8.

The drawer 8 advantageously comprises a first portion 83 for introduction into the drawer 8 of the washing additive to be introduced into the second tank 62.

In said first position (FIG. 2) of the drawer 8 the first portion 83 is advantageously in communication with the second tank 62. The first portion 83 advantageously comprises a second hole 830 fashioned in the structure 80. The first and the second hole 810, 830 are advantageously flanked.

The structure 80 involves a front portion of the drawer 8. The term "front" portion of the drawer 8 is meant the portion which is extracted first.

In the second position (FIG. 1) of the drawer 8, a second introduction zone 82 of the detergent in the drawer 8 is in communication with the washing compartment 2. The second introduction zone 82 of the detergent (visible in FIG. 3) is destined for introduction of single doses of detergent while the first zone 81 is destined for introduction of the detergent for the long fill function (the household appliance will automatically regulate the use of the reserve of detergent into a plurality of successive cycles). The second introduction zone 82 of the detergent into the drawer 8 is advantageously located (with respect to the extraction direction of the drawer 8) posteriorly of the first introduction zone 81 of the detergent.

In the second position (FIG. 1) of the drawer 8, a second introduction portion 84 of the detergent in the drawer 8 is advantageously in communication with the washing compartment 2. The second introduction zone 84 of the detergent additive into the drawer 8 is advantageously located (with respect to the extraction direction of the drawer 8) posteriorly of the first introduction zone 83 of the detergent additive.

The second introduction zone 84 of the detergent is destined for introduction of single doses of additive while the first zone 81 is destined for introduction of the additive for the long fill function (the household appliance will automatically regulate the use of the reserve of additive into a plurality of successive cycles).

Figure 3:
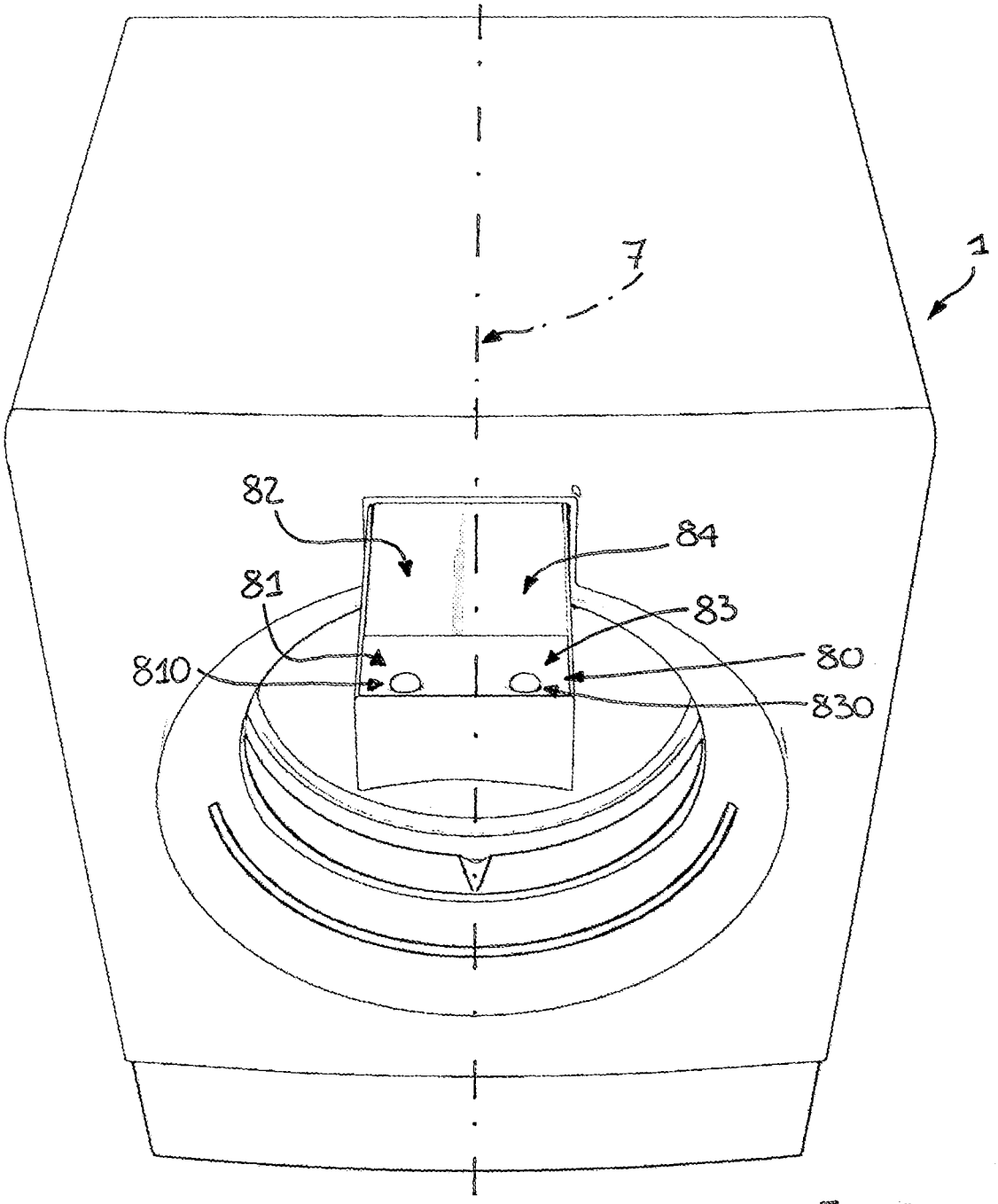

The second introduction zone 82 of the drawer 8 is accessible in a third position of the drawer 8 (see FIG. 3).

Likewise also the second portion 84 of introduction is advantageously accessible in the third position.

When the drawer 8 is in the third position the user introduces single doses of detergent and/or additive into the second zone 82 and/or in said second portion 84, but the introduction thereof into the washing compartment 2 will occur with the drawer 8 in the second position.

The drawer 8 comprises a first discharge which in the first position faces a mouth of a supply conduit to the first tank 61. The first discharge in the second position faces a mouth of a supply conduit to the first washing compartment 2.

The first discharge is destined to receive the detergent from the first and the second introduction zone 81, 82.

The drawer 8 comprises a second discharge which receives the washing additive from the first and the second introduction portion 83, 84.

The second discharge in the first position of the drawer 8 faces a mouth of a conduit directed to the second tank 62. The second discharge in the second position faces a mouth of a supply conduit to the washing compartment 2.

The drawer 8 in the third position is more greatly extracted than in the first position. In the first position (FIG. 2) the drawer 8 is more greatly extracted than in the second position. The second position (FIG. 1) usually coincides with a position of complete insertion of the drawer 8 in the household appliance 1.

The household appliance 1 comprises (automatic) means for collecting the detergent from the first tank 61 and for introduction thereof into the washing compartment 2.

The household appliance also comprises means for collecting the additive from the second tank 62 and for introduction thereof into the washing compartment 2.

In the first and in the second position of the drawer 8 the second zone 82 of introduction is inaccessible to a user. Likewise in the first and in the second position of the drawer 8 the second portion 84 of introduction is inaccessible to a user.

The present invention provides important advantages.

Primarily it enables better ergonomical characteristics of the household appliance. In fact, even a user bent in front of the access opening to the washing compartment can immediately see the level of detergent and/or additive still available.

Further, the positioning of the indicator of the load levels of the tank enables exploiting a space which alternatively would not be adequately used.

The invention as it is conceived is susceptible to numerous modifications and variants, all falling within the scope of the inventive concept characterized thereby. The materials used, as well as the dimensions, may in practice be of any type, according to needs. In practice, all the materials used, as well as the dimensions, can be any according to requirements.

The invention claimed is:

1. A household appliance for washing fabric items, comprising:

a washing compartment;

an access opening for access to the washing compartment to enable introduction and extraction of the fabric items;

a door for access to the washing compartment, mobile between a closed position in which it occludes said access opening and an open position in which it enables access to the washing compartment;

a border of said access opening to the washing compartment, said border having an exterior surface abutting the door in the closed position;

a first tank containing a detergent for washing; and a first indicator of a load level of said first tank, wherein the first indicator is non-removable relative to the border, is integrally formed with the exterior surface of the border abutting the door in the closed position, and is integrally formed with the first tank, wherein the first indicator develops along an arc of the border and a first end of the first indicator is at a higher point on the arc than a second end of the first indicator such that the first end indicates a higher level of the detergent in the first tank than the second end that indicates a lower level of the detergent in the first tank.

2. The household appliance according to claim 1, wherein the first indicator comprises a window which visualizes a level of detergent in the first tank.

3. The household appliance of claim 2, wherein the window of the first indicator exhibits a graduated scale.

4. The household appliance according to claim 3, further comprising:

a second tank which contains a washing additive;

a second indicator of a load level of said second tank, wherein said second indicator includes a window which visualizes a level of washing additive located in the second tank, said window of the second indicator is arranged along the border, is elongate and is developing in a second arc between a high and a low level over a portion of the border.

5. The household appliance according to claim 3, further comprising:

a drawer for detergents, wherein said drawer assuming at least a first and a second position, wherein in the first position a first zone of the drawer is in communication with the first tank, wherein in the second position a second zone of the drawer is in communication with the washing compartment, wherein said second zone is accessible in a third position of the drawer, wherein the drawer is more greatly extracted in said third position than in the first position and the drawer being more greatly extracted in said first position than in the second position, wherein said second position also being able to coincide with a position of complete insertion of the drawer in the household appliance, wherein the detergent from the first tank is introduced into the washing compartment.

6. The household appliance according to claim 2, wherein the first indicator develops upwards from a lower portion of the border.

7. The household appliance according to claim 2, further comprising:

a second tank which contains a washing additive;

a second indicator of a load level of said second tank, wherein said second indicator includes a window which visualizes a level of washing additive located in the second tank, said window of the second indicator is arranged along the border, is elongate and is developing in a second arc between a high and a low level over a portion of the border.

8. The household appliance according to claim 2, further comprising:

a drawer for detergents, wherein said drawer assuming at least a first and a second position, wherein in the first position a first zone of the drawer is in communication with the first tank, wherein in the second position a second zone of the drawer is in communication with the washing compartment, wherein said second zone is accessible in a third position of the drawer, wherein the drawer is more greatly extracted in said third position than in the first position and the drawer being more greatly extracted in said first position than in the second position, wherein said second position also being able to coincide with a position of complete insertion of the drawer in the household appliance, wherein the detergent from the first tank is introduced into the washing compartment.

9. The household appliance according to claim 1, wherein the first indicator develops upwards from a lower portion of the border.

10. The household appliance according to claim 9, wherein the window of the first indicator exhibits a graduated scale.

11. The household appliance according to claim 9, further comprising:

a second tank which contains a washing additive;

a second indicator of a load level of said second tank, wherein said second indicator includes a window which visualizes a level of washing additive located in the second tank, said window of the second indicator is arranged along the border, is elongate and is developing in a second arc between a high and a low level over a portion of the border.

12. The household appliance according to claim 9, further comprising:

a drawer for detergents, wherein said drawer assuming at least a first and a second position, wherein in the first position a first zone of the drawer is in communication with the first tank, wherein in the second position a second zone of the drawer is in communication with the washing compartment, wherein said second zone is accessible in a third position of the drawer, wherein the drawer is more greatly extracted in said third position than in the first position and the drawer being more greatly extracted in said first position than in the second position, wherein said second position also being able to coincide with a position of complete insertion of the drawer in the household appliance, wherein the detergent from the first tank is introduced into the washing compartment.

13. The household appliance according to claim 1, further comprising:

a second tank which contains a washing additive;

a second indicator of a load level of said second tank, wherein said second indicator includes a window which visualizes a level of washing additive located in the second tank, said window of the second indicator is arranged along the border, is elongate and is developing in a second arc between a high and a low level over a portion of the border.

14. The household appliance according to claim 13, wherein the first indicator and the second indicator develop along two different arcs which are arranged along the border on two opposite sides with respect to an imaginary vertical plane which intercepts the border and which is equidistant with respect to two flanks of the household appliance.

15. The household appliance according to claim 13, further comprising:

a drawer for detergents, wherein said drawer assuming at least a first and a second position, wherein in the first position a first zone of the drawer is in communication with the first tank, wherein in the second position a second zone of the drawer is in communication with the washing compartment, wherein said second zone is accessible in a third position of the drawer, wherein the drawer is more greatly extracted in said third position than in the first position and the drawer being more greatly extracted in said first position than in the second position, wherein said second position also being able to coincide with a position of complete insertion of the drawer in the household appliance, wherein the detergent from the first tank is introduced into the washing compartment.

16. The household appliance according to claim 1, further comprising:

a drawer for detergents, wherein said drawer assuming at least a first and a second position, wherein in the first position a first zone of the drawer is in communication with the first tank, wherein in the second position a second zone of the drawer is in communication with the washing compartment, wherein said second zone is accessible in a third position of the drawer, wherein the drawer is more greatly extracted in said third position than in the first position and the drawer being more greatly extracted in said first position than in the second position, wherein said second position also being able to coincide with a position of complete insertion of the drawer in the household appliance, wherein the detergent from the first tank is introduced into the washing compartment.

17. The household appliance according to claim 16, wherein when the drawer is in the first and in the second position, the second zone of the drawer is inaccessible to a user.

18. The household appliance according to claim 17, wherein said drawer comprises a first discharge which in the first position faces a mouth of a supply conduit to the first tank and in the second position faces a mouth of a supply conduit to the washing compartment.

19. The household appliance according to claim 16, wherein said drawer comprises a first discharge which in the first position faces a mouth of a supply conduit to the first tank and in the second position faces a mouth of a supply conduit to the washing compartment.

20. The household appliance according to claim 1, wherein said door comprises:

a transparent porthole window which enables viewing an inside of the washing compartment from outside the household appliance; and a perimeter structure which surrounds the transparent porthole window and which in the closed position of the door is abutted by the border.

* * * * *